US005291825A

United States Patent [19]

Dietrich

[11] Patent Number: 5,291,825

[45] Date of Patent: Mar. 8, 1994

[54] COMPACTING DEVICE INCLUDING BALE SIZE INDICATOR AND COMPACTING PROTRUSIONS

[76] Inventor: Carl O. Dietrich, 469 Portman Rd., Butler, Pa. 16001

[21] Appl. No.: 87,338

[22] Filed: Jul. 8, 1993

Related U.S. Application Data

[63] Continuation-in-part of Ser. No. 959,544, Oct. 13, 1992, abandoned.

[51] Int. Cl.[5] ..... B30B 9/00; B30B 15/00

[52] U.S. Cl. ..... 100/98 R; 100/99; 100/215; 100/218; 100/245; 100/250; 100/295

[58] Field of Search ..... 100/98 R, 99, 215, 218, 100/240, 245, 246, 247, 249, 250, 255, 295, 902

[56] References Cited

U.S. PATENT DOCUMENTS

| | | | |
|---|---|---|---|
| 47,684 | 5/1865 | Steele | 100/98 R X |
| 810,998 | 1/1906 | Thomas | 100/98 R X |
| 876,352 | 1/1908 | Holden | 100/99 |
| 2,537,920 | 1/1951 | Smith | 100/249 X |
| 3,062,130 | 11/1962 | Huber et al. | 100/295 X |
| 3,104,607 | 9/1963 | Galas | 100/902 X |
| 3,577,911 | 5/1971 | Morse | 100/250 X |
| 3,580,166 | 5/1971 | Longo | 100/250 X |
| 3,785,281 | 1/1974 | Ligh | 100/295 X |
| 3,822,638 | 7/1974 | Merkin | 100/99 X |
| 3,863,779 | 2/1975 | Stockman | 100/99 X |
| 4,483,246 | 11/1984 | Sullivan et al. | 100/902 X |
| 4,541,332 | 9/1985 | Horansky et al. | 100/902 X |
| 4,601,238 | 7/1986 | Davis, Jr. et al. | 100/902 X |

FOREIGN PATENT DOCUMENTS

| | | | |
|---|---|---|---|
| 233424 | 5/1959 | Australia | 100/98 R |
| 124175 | 10/1901 | Fed. Rep. of Germany | 100/99 |
| 2451821 | 11/1980 | France | 100/98 R |

*Primary Examiner*—Stephen F. Gerrity

[57] ABSTRACT

A compacting device for conforming a variety of refuse materials, such as glass and plastic, into generally rectilinear bales, and for compacting aluminum and tin refuse material into generally square-shaped stable bales for recycling. The compacting device includes a housing enclosing a chamber and an extendable and retractable plunger disposed within the chamber. A hopper receives refuse material to be crushed or compacted, and directs the material into the chamber. An exit chamber door has a plurality of equidistantly spaced-apart rectilinear chamber door protrusions projecting from the inner face of the exit chamber door, and the face of the plunger includes a plurality of equidistantly spaced-apart rectilinear plunger face protrusions extending forwardly from the plunger face. The plunger face protrusions are adapted for forcibly contacting and compressing the material deposited within the chamber door protrusions. The plunger face is disposed parallel to the exit chamber door when the chamber door is closed, and when the plunger is extended for crushing and conforming material, the plunger face protrusions move in respective parallel planes that coincide with the spaces between the chamber door protrusions. When aluminum and tin material is deposited in the chamber, the arrangement of the plunger face protrusions and the chamber door protrusions facilitates the interlocking and binding together of the material during deformation and compaction between the plunger and the chamber door.

14 Claims, 5 Drawing Sheets

COMPACTING DEVICE INCLUDING BALE SIZE INDICATOR AND COMPACTING PROTRUSIONS

This is a continuation-in-part of co-pending application Ser. No. 07/959,544, filed Oct. 13, 1992 (abandoned).

BACKGROUND OF THE INVENTION

The present invention pertains to compacting devices, and more particularly pertains to a compacting device which conforms recyclable and non-recyclable refuse material into generally rectilinear bales, and which conforms aluminum and tin material into generally stable, square-shaped bales that can be easily stored and transported for recycling into usable products. The compacting device of the present invention also compacts material such as glass, plastic, and cardboard for storage and eventual recycling.

As America enters the twenty-first century, the condition and viability of the environment will be crucial for continued economic progress as well as the general health of our society. Recycling the innumerable materials our industrial society produces is of paramount importance if we are to prevent further degradation of the environment and check the depletion of our natural resources.

The amount of material—garbage—that contemporary American society produces and which must be consequently disposed of in some manner is enormous and growing. An average of four pounds of garbage are tossed out each day by every American. This amounts to one-half ton of garbage produced and consequently pitched out each year by every American. Nationally this amounts to 179.6 million tons of garbage generated annually—enough to fill a convoy of ten-ton garbage trucks more than 145,000 miles long. This tremendous amount of garbage is predicted to rise; the Environmental Protection Agency estimates that by the year 2000 each American will generate 4.4 pounds of garbage daily, amounting to 216 million tons annually.

The staggering amount of garbage contemporary society produces is compounded by the fact that our main means of disposal is by landfills—73% of America's garbage is deposited into landfills. Exacerbating the problem is the fact that one-third of existing landfills will close in two years, and 80% are scheduled to shut down within twenty years. The disposal of the rest of our garbage is through recycling (13%) and incineration (14%). With opposition to landfills and waste incinerators increasing costs for existing facilities and preventing the construction of new facilities, more productive, creative, and cost-effective ways for disposing of our garbage must be found.

Although recycling is not a panacea to society's garbage problem, it is an obvious and necessary component of the solution. A number of products used by the typical American household are recyclable. The products include: newspapers, magazines and catalogs, telephone books, food jars, beverage bottles, beverage containers, milk containers, polystyrene sandwich clamshells, cups and plates, aluminum beverage cans, and "tin" cans for food and beverages (steel that is sometimes plated with tin). According to 1988 statistics, glass, metals, and plastics account for 23.5% of household trash. However, the recycling prospects for glass food jars and beverage bottles, plastic beverage containers, aluminum beverage cans, and tin-plated steel food and beverage cans are rated as very good to excellent. (The above statistics were published in "How We Can Win Our War Against Garbage", *Popular Science*, October 1990.)

The first step in the recycling and reclamation process is to break down or reduce the material to a form in which the material can be transported to recycling centers. In reduced or broken down form the material can be temporarily stored at these centers while awaiting further processing at a materials recovery facility.

A number of devices have been employed to break down or reduce bulk items like glass bottles, plastic containers, aluminum and steel cans. The devices range from large compacting and separating devices for industrial facilities to small compacting devices for household use. For example, the Sullivan et al. U.S. Pat. No. 4,483,246 discloses an apparatus and an associated method for crushing metal containers. Sullivan's compactor includes a housing having a compaction chamber and a supply means for providing material to the compaction chamber. The compactor includes a first ram for compacting the material and a second ram for discharging the compacted material from the compactor. It is a large and cumbersome device which is impractical for households and even small businesses. Despite such inventions, there remains a need for a compacting device which is portable, easy to operate and maintain, and capable of compacting material into a form that can be easily managed for disposal or for storage and transportation to a recycling center or materials recovery facility.

SUMMARY OF THE INVENTION

The present invention comprehends a compacting device for crushing a variety of recyclable and non-recyclable refuse materials. The device is especially adapted to compact aluminum and tin material into stable, cohesive, unitary, square-shaped bales that can be conveniently stored and easily transported.

The compacting device of the present invention includes an elongated, tubular housing which defines a chamber extending therethrough for receiving the material to be crushed and compacted. A hopper is mounted atop the housing and registers with the chamber. Material is dumped into the hopper and directed into the chamber. A reciprocable plunger is mounted within the chamber and is adapted for selective extension and retraction therein to crush and compact material deposited in the chamber. An exit chamber door is mounted to the housing and is adapted for closing the chamber during compaction and opening to allow ejection of the material after compaction.

Separate structural elements mounted on the exit chamber door and the plunger are employed to crush and compact the material into rectilinear bales, or when aluminum and tin material is deposited in the chamber, into a stable square-shaped bale. Specifically, the plunger has a flat plunger face, and mounted to the plunger face are a plurality of equidistantly spaced-apart, parallel plunger face protrusions which forcibly contact and compress the material against the closed exit chamber door. Mounted to the exit chamber door are a plurality of equidistantly spaced-apart, parallel chamber door protrusions adapted to project into the material as the material is being crushed and compacted by the plunger face and the plunger face protrusions. As the plunger is extended for crushing and compacting material, the plunger face protrusions move in respective parallel planes that coincide with the spaces between the chamber door protrusions.

It is an objective of the present invention to provide a compacting device which is easy to operate and maintain.

It is another objective of the present invention to provide a compacting device which can be adapted for mounting to the bed of a pick-up truck or trailer, or which can be adapted for manual transportation from one location to another.

Yet another objective of the present invention is to provide a compacting device capable of compacting material into square-shaped bales by utilizing plunger face protrusions which move in separate parallel planes to the respective parallel planes of the stationary chamber door protrusions for effecting the interlocking and binding together of the material.

These and other objects of the invention will be more fully understood from the following description of the invention with reference to the illustrations appended hereto.

These and other objects of the invention will be more fully understood from the following description of the invention with reference to the illustrations appended hereto.

DETAILED DESCRIPTION OF THE PREFERRED EMBODIMENT

Referring to FIGS. 1–8 there is shown a compacting device 10 for crushing and compacting recyclable and non-recyclable refuse materials. The recyclable materials include glass food jars and beverage bottles, plastic beverage containers, milk containers, aluminum beverage cans, aluminum siding, and tin food and beverage cans (steel that is sometimes coated with tin). The device 10 is adapted to crush and compact the aforementioned recyclable materials into generally rectilinear bales so that they can be easily disposed of or stored and conveniently transported to a recycling center or materials recovery facility. More specifically, the device 10 is adapted to crush and compact aluminum and/or tin recyclable material 12 into a stable, unitary, cohesive, generally square-shaped bale 14. The bale 14 can be efficiently stored and easily transported. The device 10 is intended for use at local municipalities, recycling centers, materials recovery facilities, truck stops, restaurants, and households and, as shall be hereinafter described, the device 10 can be either a stationarily-mounted unit or a portable unit.

Figure 8:
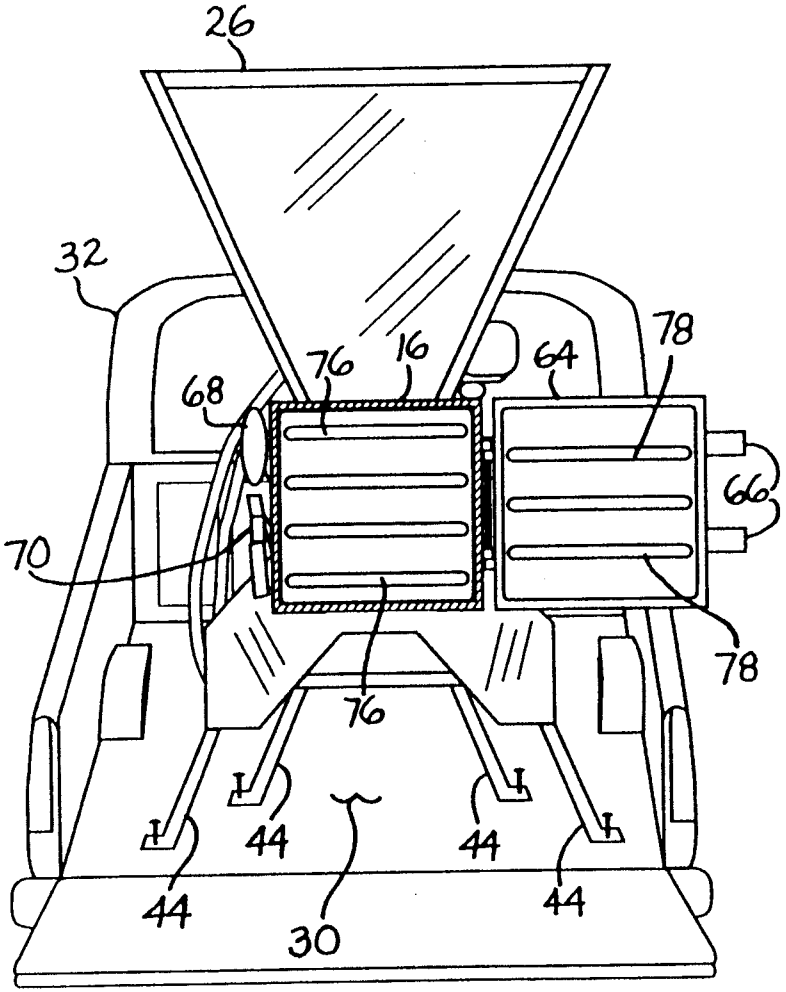
FIG. 8 is a rear elevational view of the device first shown in FIG. 7 illustrating the device mounted to the bed of a pick-up truck.
Figure 7:
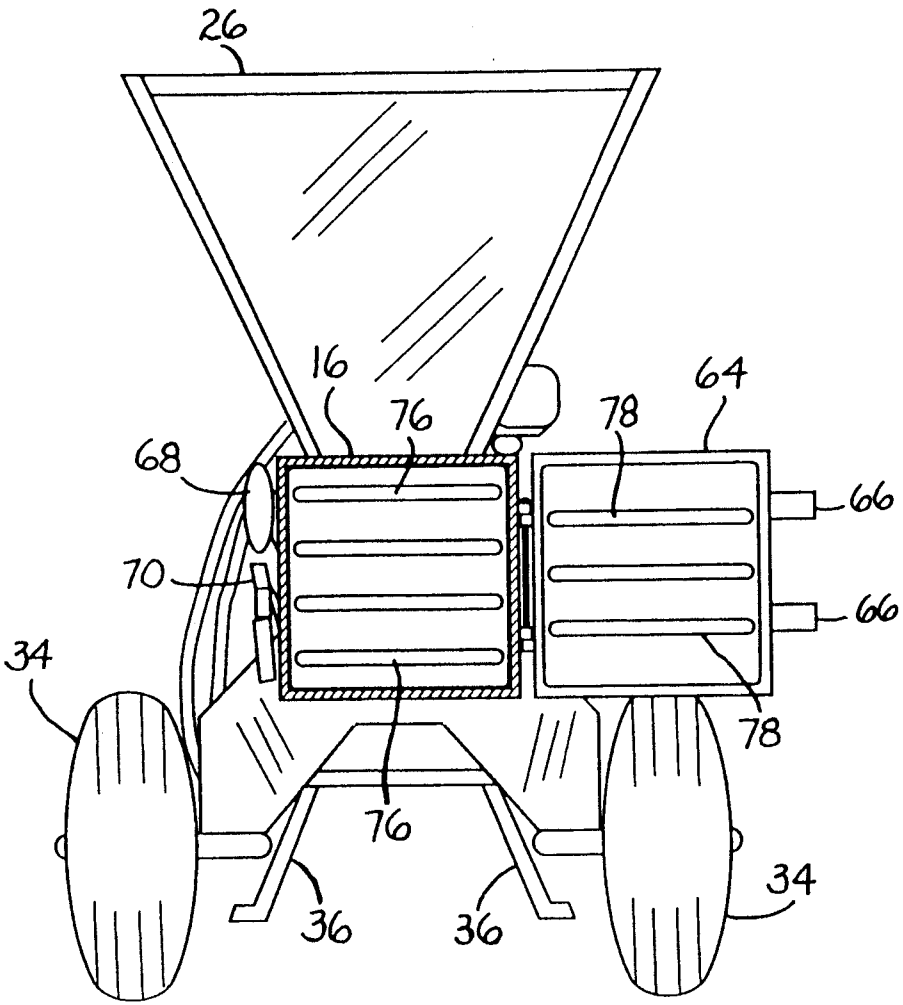
FIG. 7 is a rear elevational view of the device first shown in FIG. 1.

As illustrated in FIGS. 1–4 and 6–8, the device 10 includes an elongated, generally tubular-shaped housing 16 which would normally be disposed horizontal and parallel to any level surface. In the preferred embodiment, the elongated housing 16 is a 10″×10″ steel square tubing, but the length of the housing 16 and the gauge of the steel used can be varied depending upon the pressure produced within the housing 16. The housing 16 has an open front end 18 and an oppositely-disposed open rear end 20. Located atop the housing 16 and positioned toward the end 18 is a material receiving aperture 22 which registers with an interior chamber 24 extending from the end 18 to the end 20. An upwardly-opening hopper 26 is secured to the housing 16 and registers with the aperture 22. Material 12 is dumped into the hopper 26 whereupon it passes through the aperture 22 for deposition into the chamber 24. Once the material 12 is deposited into the chamber 24, it will be crushed and compacted into generally rectilinear or stable, square-shaped bales as hereinafter described. FIG. 8 shows a covering 28 for the hopper 26 which can be utilized for safety purposes.

Figure 1:
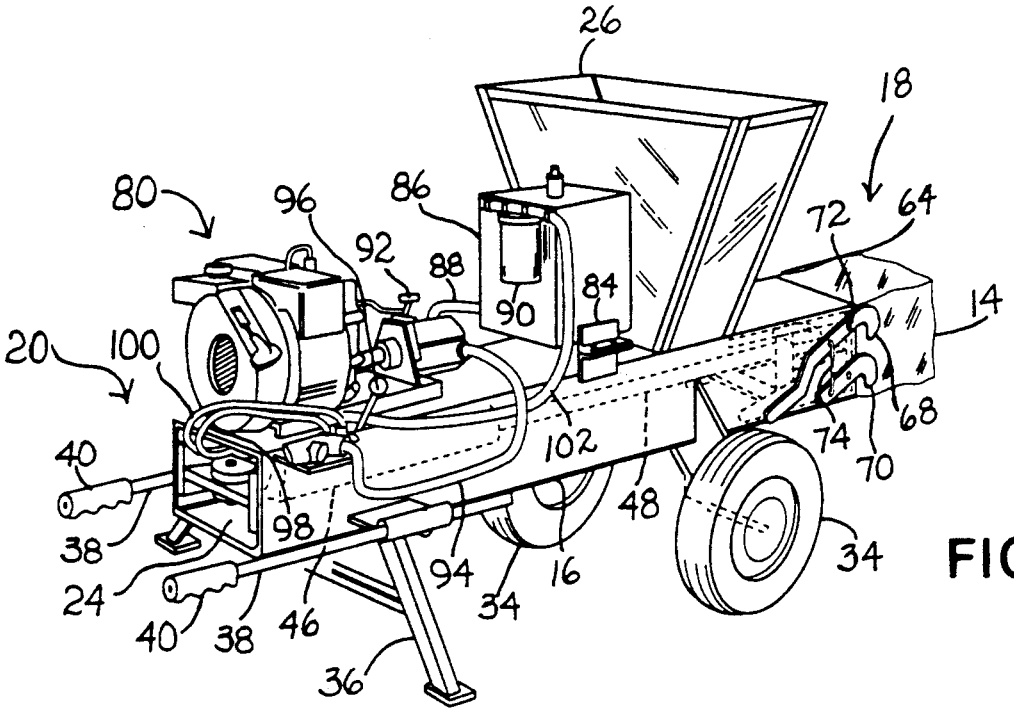
FIG. 1 is a perspective view of the device of the present invention.
Figure 2:
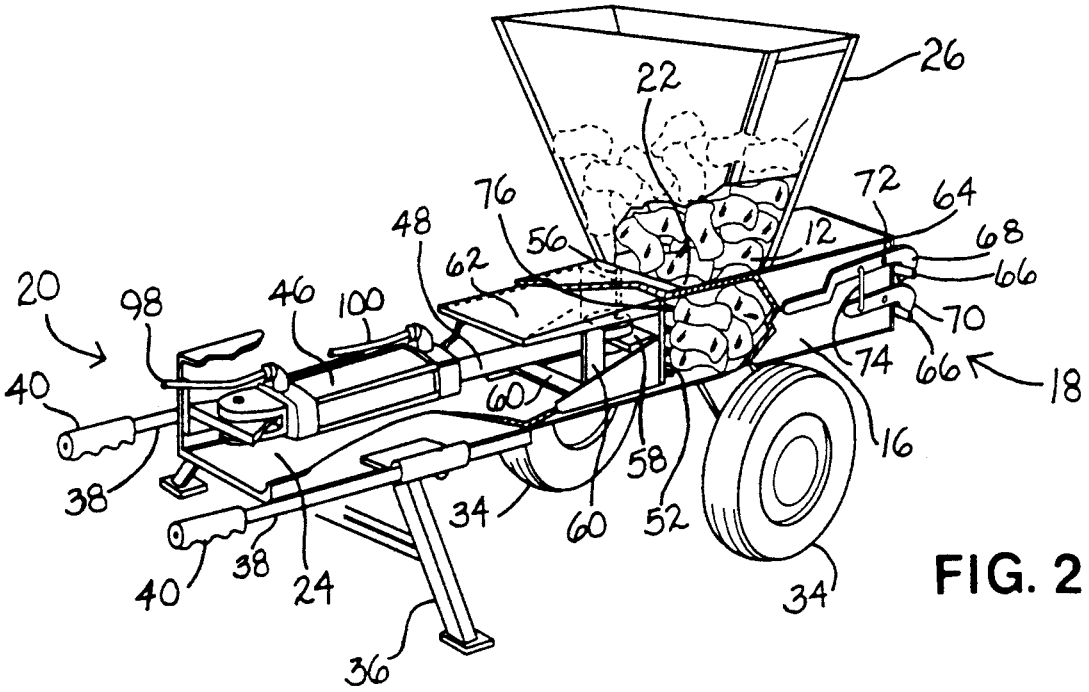
FIG. 2 is a perspective view of the device first shown in FIG. 1 with a portion of the device broken away to reveal internal structural components.
Figure 4:
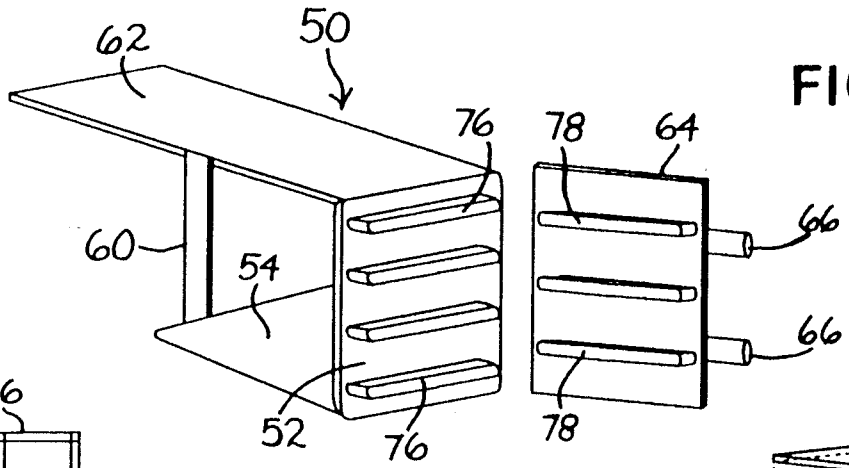
FIG. 4 is an enlarged fragmentary view of structural components of the device first shown in FIG. 1.
Figure 5:
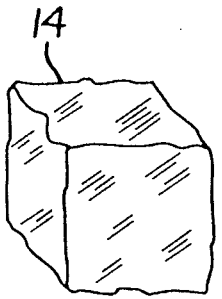
FIG. 5 is a perspective view of a square-shaped bale of material compacted by the device which was first shown in FIG. 1.
Figure 6:
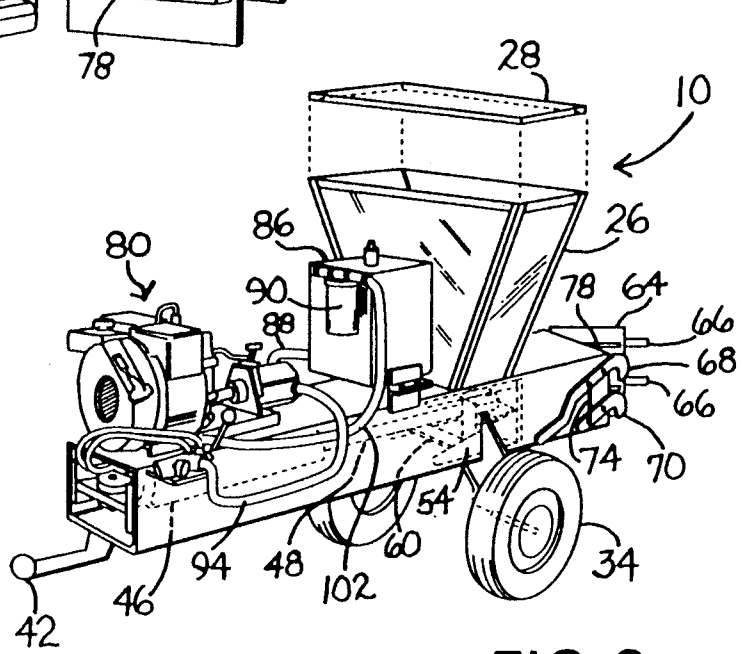
FIG. 6 is a perspective view of the device first shown in FIG. 1 illustrating an alternative method for transporting the device.

In FIGS. 1 and 2 the device 10 is adapted to be manually portable, while FIG. 6 illustrates the device 10 adapted for attachment to the hitch of a motor vehicle, and FIG. 8 illustrates the device 10 permanently mounted to the bed 30 of a pick-up truck 32. The device 10 of FIG. 1 and 2 includes a pair of wheels 34, which can be wheelbarrow wheels, attached to the housing 16 adjacent the end 18 and a pair of supports 36 attached to the housing 16 adjacent the end 20 and projecting downwardly for placement upon the level surface. Secured to either side of the housing 16 adjacent the end 20 are a pair of elongated handles 38 with grippers 40 that extend horizontally with respect to the housing 16. In FIG. 6 the supports 36 and the handles 38 are removed and, instead, a trailer hitch 42 is mounted to the housing 16 immediately below the end 20 so that the device 10 can be hitched to a motor vehicle and transported from one location to another. Finally, in FIG. 8 the device 10 is permanently mounted to the bed 30 by four elongated supports 44 that are bolted to the bed 30.

As shown in FIGS. 1–3 and 6, a hydraulic cylinder 46 is mounted within the housing 16 and attached to the cylinder 46 by a piston rod 48 is a reciprocable and linearly movable plunger 50 which is adapted for crushing and compacting material deposited within the chamber 24. The plunger 50 is adapted for selective reciprocable extension and retraction within the housing 16 by the cylinder 46. The plunger 50 has a flat plunger face 52 which is disposed vertical to the horizontal disposition of the device 10. The face 52 is adapted to forcibly contact and crush the material 12 deposited within the chamber 24; when aluminum and tin recyclable materials are deposited within the chamber 24, the face 52 forcibly compresses and compacts the aluminum and tin material into the square-shaped bale 14. When the plunger 50 is fully extended within the chamber 24 for crushing and compacting material 12, 7.5 tons of pressure are exerted by the face 52 against the material 12. Therefore, the plunger 50 must be designed to withstand such an extreme pressure. The plunger 50 includes reinforcing structural elements to prevent breaking or twisting during the full extension of the plunger 50 when crushing and compressing the material 12. In order to guide the plunger 50 during its extension and retraction within the chamber 24, and also to prevent the plunger 50 from twisting due to the enormous pressure being exerted within the chamber 24, the plunger 50 includes a pair of spaced-apart, flat, triangular-shaped plates or riders 54 which are attached to the face 52 and project rearwardly therefrom. The riders 54 extend rearwardly from the face 52 and are perpendicular to the vertically-extending plane of the face 52. Furthermore, the riders 54 slide and ride upon the inside surface of the housing 16 as the plunger 50 is extended or retracted.

Figure 3:
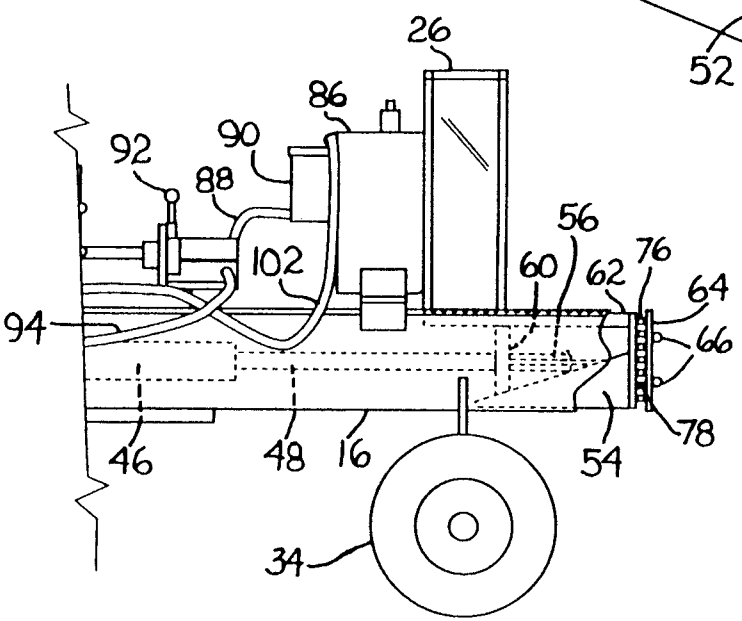
FIG. 3 is a side elevational view of the device first shown in FIG. 1.

The end of the rod 48 is shaped like a yoke, as shown in FIGS. 1-3 and 6, and each prong of the yoke has either threaded or non-threaded throughholes (not shown) for receiving a pin or bolt 56. Mounted immediately behind the face 52 and horizontal thereto is a bracing plate 58 having a threaded hole (not shown) extending therethrough. The prongs of the rod 48 are fitted over and under the plate 58 so that all of the threaded holes are aligned and then the bolt 56 is inserted therethrough, thus attaching the plunger 50 to the cylinder 46. The plate 511, also helps to maintain the position of each rider 54 by having the ends of the plate 58 abut each respective rider 54. The opposite ends of the plate 58 can be welded to the inside surfaces of each respective rider 54. In addition, as shown in FIGS. 1-4 and 6, the plunger 50 includes a plurality of reinforcing plates 60 which prevent the plunger 50 from pushing sideways and twisting within the chamber 24 during extension for crushing and compacting material 12. The device 10 utilizes three plates 60: one plate 60 horizontally extends between and is attached to the inside flat surface of each rider 54, and the other two plates 60 project upward from, and are contiguous to, each respective rider 54 to the top of the plunger 50. The plate 60 that horizontally extends between the riders 54 rides upon the lower inside surface of the housing 16 as the plunger 50 is retracted and extended within the chamber 24. In addition, the plunger 50 includes a closure means which is disposed horizontal and transverse to the face 52 and is secured adjacent the top of the face 52. The closure means includes a flat top plate 62 which extends rearwardly of the face 52 and moves adjacent the upper inside surface of the housing 16 when the plunger 50 is extended or retracted. The upwardly-projecting plates 60 also attach to the bottom of the plate 62. When the plunger 50 is fully extended within the chamber 24 as shown in FIG. 3, the plate 62 completely covers the aperture 22 and blocks the aperture 22 to prevent material from falling down into the chamber 24. It should be noted that when the plunger 50 is reciprocally moving within the chamber 24 for compressing and compacting material there is a minute gap between the face 52 and the surrounding inside surface of the housing 16.

As shown in FIGS. 1-4 and 6-8, the device 10 includes an exit chamber door 64 attached to the housing 16 adjacent the end 18 and which is adapted for selective closure of the chamber 24 to effect material compression and compaction against its inner door surface and opening thereof to permit ejection of the compressed and compacted material. The door 64 can be hingeably mounted to the housing 16, and closes the end 18 of the chamber 24 so that refuse material can be crushed and compacted against the door 64. Permanently secured to the exterior of the door 64 are a pair of spaced-apart latch shafts or bars 66. Mounted to the exterior of the housing 16 adjacent the end 18, and adapted for selective pivotal movement to either lock or unlock the door 64, are a pair of latches 68 and 70. The latches 68 and 70 are pivotally mounted to the housing 16 by a latch pin or bolt 72 and are adapted to pivot in tandem with each other. The tandem pivoting of each latch 68 and 70 is achieved by utilizing a pivot rod 74 which extends between and is attached to each latch 68 and 70 so that when the user manually presses down on the handle of the larger latch 68 the smaller latch 70 will concomitantly pivot therewith for locking or unlocking the door 64.

Referring to FIGS. 3, 4, 7, and 8, there is shown a plurality of equidistantly spaced-apart rectilinear plunger face protrusions 76 attached to the face 52. The protrusions 76 are located in spaced parallel arrangement to each other and are horizontally disposed on the face 52. The device 10 utilizes four protrusions 76; while fewer or more protrusions 76 may be mounted to the face 52, it is believed that this is the optimum number for the most efficient compression and compaction of recyclable material. The protrusions 76 project or extend forwardly from the face 52 and are adapted to forcibly contact and compress the material 12 deposited within the chamber 24 against the inner door surface of the door 64 in order to crush and break down the material into generally rectilinear bales, and when aluminum and/or tin is deposited within the chamber 24, the protrusions 76 compact the material 12 into the generally square-shaped bale 14. The protrusions 76 may be integrally formed from the face 52 or may be steel bars welded permanently onto the face 52. The preferred embodiment of the invention uses steel bars.

Referring to FIGS. 1, 3, 4, and 6-8, there is shown a plurality of equidistantly spaced-apart chamber door protrusions 78 mounted to the door 64. More specifically, the preferred embodiment of the device 10 includes three rectilinear protrusions 78 mounted horizontal on the inner surface of the door 64 and parallel to each other. The protrusions 78 may be steel rods or bars which are permanently welded and secured to the inner surface of the door 64 or may be integrally formed on the inner surface of the door 64. There are a number of advantages in utilizing the protrusions 76 and 78 for compressing and crushing recyclable material, and especially for compressing and compacting aluminum and tin materials 12 into the bales 14. The protrusions 76 and 78 are adapted to increase the surface area which forcibly contacts and compresses the recyclable material during the process of compaction; the surface-to-surface area of metal contact is increased. In addition, as shown in FIG. 3, the protrusions 76 and 78 form an interleaved arrangement when no material is in the chamber 24 and the plunger 50 is fully extended against the door 64. As the protrusions 76 move toward the door 64, their respective parallel planes coincide with the spaces between the protrusions 78. The parallel planes which project from each protrusion 78 also coincide with the spaces between each protrusion 76 on the plunger face 52. Two opposed flat surfaces will not cause the interlocking or binding together of the aluminum and tin recyclables; however, by utilizing the protrusions 76 and 78 to forcibly contact and compress the material 12, the interlocking and binding together of the aluminum and tin recyclables is achieved. Moreover, the overall rough surface contact against the material 12 is increased by using the protrusions 76 and 78 and the chances of the aluminum and tin material 12 breaking apart is decreased. Finally, when aluminum and tin material 12 is deposited within the chamber 24 for compaction, the central mass of the material 12 is tightly compacted and bound together by the protrusions 76 and 78 forcibly contacting and compressing the material 12 between the face 52 and the inner surface of the door 64. Thus, even if aluminum and tin fragments and strips at the exterior of the bale 14 fall off, the central mass of the bale 14 will be tightly bound together.

Referring to FIGS. 1–3 and 6, the device 10 includes a motor means for driving the plunger 50 for selective extension and retraction within the chamber 24. The motor means may include a 5 hp. Briggs and Stratton gasoline engine 80. A 3 hp. electric engine can also be used by the device 10. The engine 80 provides the power for a hydraulic pump 82 and both the engine 80 and the pump 82 are mounted atop the housing 16 adjacent the end 20. Mounted to the top of the housing 16 by two pairs of angle irons 84 and positioned beside the hopper 26 is a five-gallon tank 86 for containing the hydraulic fluid (oil). By mounting the tank 86 to the housing 16 by means of the angle irons 84 allows the tank 86 to be easily removed by simply removing the pins or bolts that secure the angle irons 84 together and lifting up the tank 86. A feed line 88 runs from the bottom of the tank 86 into the pump 82 and the hydraulic fluid is simply gravity-fed into the pump 82. A filter 90 is mounted to the tank 86 for filtering return hydraulic fluid. A throttle valve 92 on the pump 82 regulates the engine 80 and controls the flow velocity of the hydraulic fluid from the tank 86. A pressure line 94 carries the hydraulic fluid from the pump 82 to the cylinder 46. A control or hydraulic valve 96 regulates the flow of hydraulic fluid into the cylinder 46 for extending and retracting the plunger 50 during the compression and compaction of material 12 deposited into the chamber 24. Running from the control valve 96 and conjected to and in flow communication with each end of the cylinder 46, respectively, is a forward control line 98 and a reverse control line 100. For extending the plunger 50 the control valve 96 is adjusted so as to permit hydraulic fluid flow through the pressure line 94 and into the forward control line 98 which connects to the outer end of the cylinder 46. For retracting the plunger 50 the control valve 96 is adjusted so as to permit hydraulic fluid flow through the pressure line 94 and then through the reverse control line 100 which connects to the inner end of the cylinder 46. A return line 102 runs from the cylinder 46 to the filter 90 for permitting hydraulic fluid to flow from the cylinder 46 and through the filter 90 back into the tank 86.

It is a simple process to crush and compact re-use material for environmentally safe disposal and recyclable material for storage and eventual transportation to a recycling center or materials recovery facility. First, the user retracts the plunger 50 so that the plate 62 uncovers the aperture 22. The door 64 should be locked shut beforehand by using the pair of pivoting latches 68 and 70. Because the door 64 is hingeably mounted to the housing 16, the door 64 functions as a removable closure for closing off the end 18 of the chamber 24. Material 12 can then be deposited into the hopper 26 and, because the plate 62 has uncovered the aperture 22 when the plunger 50 is fully retracted, the material 12 will fall through the hopper 26 and into the chamber 24. The size of the hopper 26 can be varied to accommodate differently sized compacting devices; in the device 10 the hopper 26 is sized to hold one 30-gallon garbage bag of material such as recyclable aluminum and tin cans. Once the material 12 is deposited within the chamber 24, it usually takes two good cycles of extension and retraction by the plunger 50 to crush and compress the material 12 within the chamber 24 and against the protrusions 78 and inner surface of the door 64. Then, a second 30-gallon garbage bag filled with, for example, aluminum and tin cans, can be dumped into the hopper 26 for deposition within the chamber 24. After several more cycles the material 12 from the second garbage bag is also fully crushed and compressed so that a compact, stable, unitary bale 14 of aluminum and tin recyclable material is created. To insure that the bale 14 will maintain its stable and uniform shape, the plunger 50 can be worked several more times back and forth within the chamber 24 to further compress and compact the material 12. The door 64 can be unlatched and opened and then the plunger 50 can be extended one more time to push and eject the compact bale 14 out of the chamber 24 and onto the ground or onto a pallet or other receiving surface. If the material being crushed is glass food and beverage jars or plastic containers, the crushed material in the form of rectilinear strips, shreds, or fragments can be pushed into containers or bins after several plunger 50 cyclings. Because of the minute gap between the face 52 and the surrounding interior surface of the housing 16, no material slips or escapes behind the face 52 as the plunger 50 is reciprocably cycled within the chamber 24.

Figure 9:
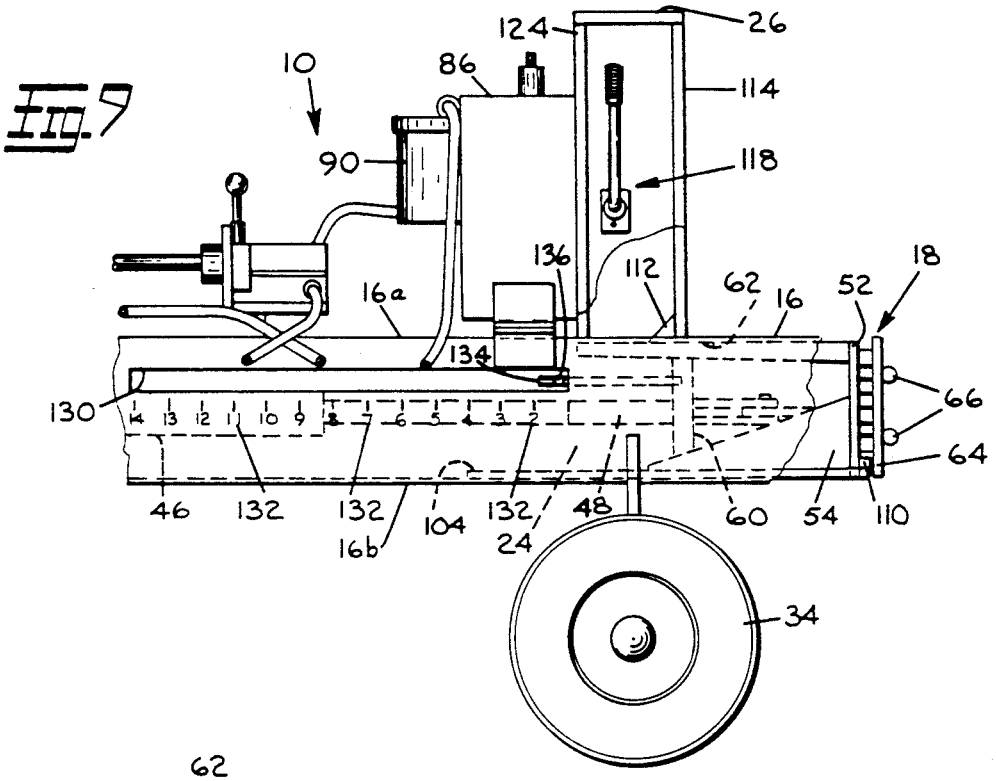
FIG. 9 is a side elevational view of the alternate preferred embodiment of the device first shown in FIG. 3.
Figure 10:
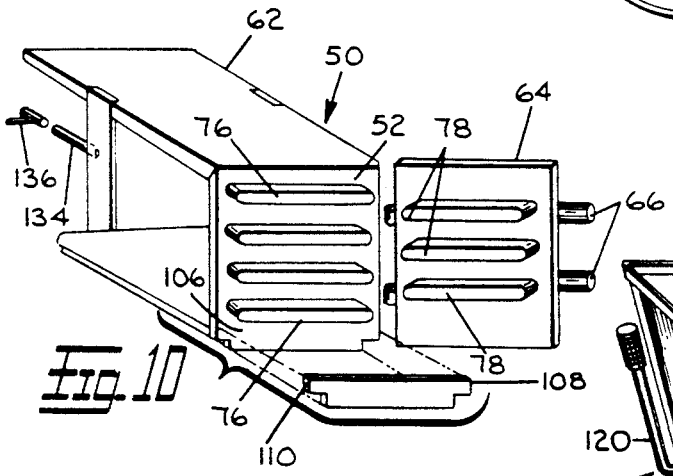
FIG. 10 is an enlarged fragmentary view of structural components first shown in FIG. 4 illustrating additional structural features.
Figure 11:
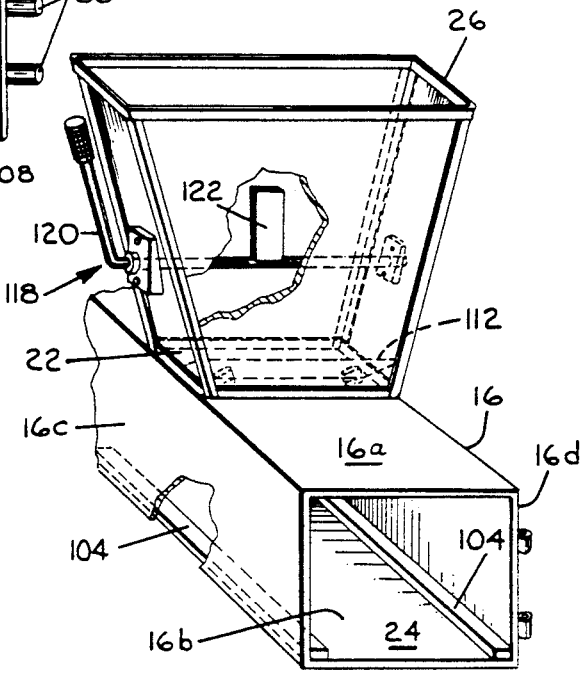
FIG. 11 is an enlarged fragmentary perspective view of the device first shown in FIG. 1 illustrating additional structural features.

Referring to FIGS. 9–13, there is shown an alternate preferred embodiment for the device 10 that includes a number of features which enhance the efficiency of the device 10 and also increase its useful working life. The square-shaped housing 16 is further defined by a flat top member **16*a*, an opposed bottom surface or floor 16*b*, and a pair of spaced-apart, vertically depending sidewalls 16*c* and 16*d*. The elongated chamber 24 is enclosed by the housing 16 and extends completely therethrough. Shown in FIGS. 9 and 11 are a pair of spaced-apart, elongated wear bars 104. The wear bars 104 can be welded or bolted to the floor 16*b*, and extend from the end 18 along the lowest portion of each sidewall 16*c* and 16*d* to a point adjacent the cylinder 46. Depending on the size of the device 10 and the length of the generally square or rectangular-shaped housing 16, the wear bars 104 may extend only three or four inches past the hopper 26 and not to a point adjacent the cylinder 46. In either case, the plunger face 52 will ride upon the bars 104 during the complete length of travel of the plunger face 52 during extension and retraction for a baling operation. One possible dimension for the wear bars 104 will be one and one-half inches wide and one-quarter of an inch thick, and the wear bars 104** will be surface-hardened steel material.

Figure 13:
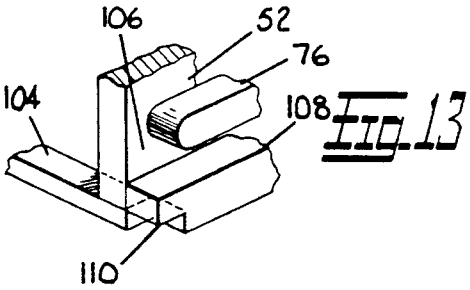
FIG. 13 is an enlarged fragmentary view of structural components of the device first shown in FIG. 9.

As shown in FIGS. 9, 10, and 13, corner notches 106 at the bottom portion of the plunger face 52 mate with each respective wear bar 104. In order to keep the bottom surface of the plunger face 52 from wearing out due to friction produced by sliding against the floor 16 during plunger 50 extension and retraction, a wear plate 108 is mounted or secured to the lowest portion of the plunger face 52. The wear plate 108 may be bolted to the lowest portion of the plunger face 52 so that it can be removably secured thereto, or the wear plate 108 may be welded, and thus permanently affixed, to the lowest portion of the plunger face 52. The wear plate 108 can be either a bar which extends between the corner notches 106 and abuts the floor **16*b*, or the wear plate 108 can be shaped to extend between the corner notches 106 and also to have opposite projecting portions 110 extending to the edges of the plunger face 52 and flush with the corner notches 106. During plunger 50 extension and retraction during a baling operation, the wear plate 108 will ride upon the floor 16*b* and also the opposite portions 110 will ride upon each respective wear bar 104**.

Referring to FIGS. 9 and 11, there is shown a shear bar 112 disposed within the hopper 26. More specifically, the shear bar 112 is adapted for removable placement and adjustment to a front upright wall 114 of the hopper 26 adjacent the open end 18. The shear bar 112 is a generally triangular-shaped object with two spaced-apart oblong holes (not shown) that align with spaced-apart oblong through-holes (not shown) located at the bottom of the wall 114. The shear bar 112 is positioned immediately above and adjacent to the aperture 22 which communicates with the hopper 26 and opens into the chamber 24 and allows material 12 to pass from the hopper 26 into the chamber 24 for baling. The shear bar 112 bolts to the wall 114 and, because both the shear bar 112 and the wall 114 have aligned oblong through-holes, the shear bar 112 can be slidably and selectively adjusted up or down before being appropriately secured to the inside surface of the wall 114. The shear bar 112 is normally mounted so that it is immediately above the plate 62 and only a minute clearance exists between the plate 62 and the shear bar 112 when the plate 62 moves toward the end 18 during plunger 50 extension and retraction within the chamber 24. When elongated pieces of material, such as pieces of aluminum siding or aluminum sheeting material, are deposited within the chamber 24, a portion of the length of such material may extend up through the aperture 22 and into the hopper 26. As the plunger 50 is extended and the plunger face 52 and face protrusions 76 contact and begin to push the elongated pieces of material toward the chamber door 64 and the door protrusions 78, the material is pushed against and sliced off by the shear bar 112. The shear bar 112 only engages and slices or cuts off elongated pieces of material that extend from the chamber 24 up through the aperture 22 and into the hopper 26 which cannot be properly compacted and deformed unless such material is cut down to size.

Figure 12:
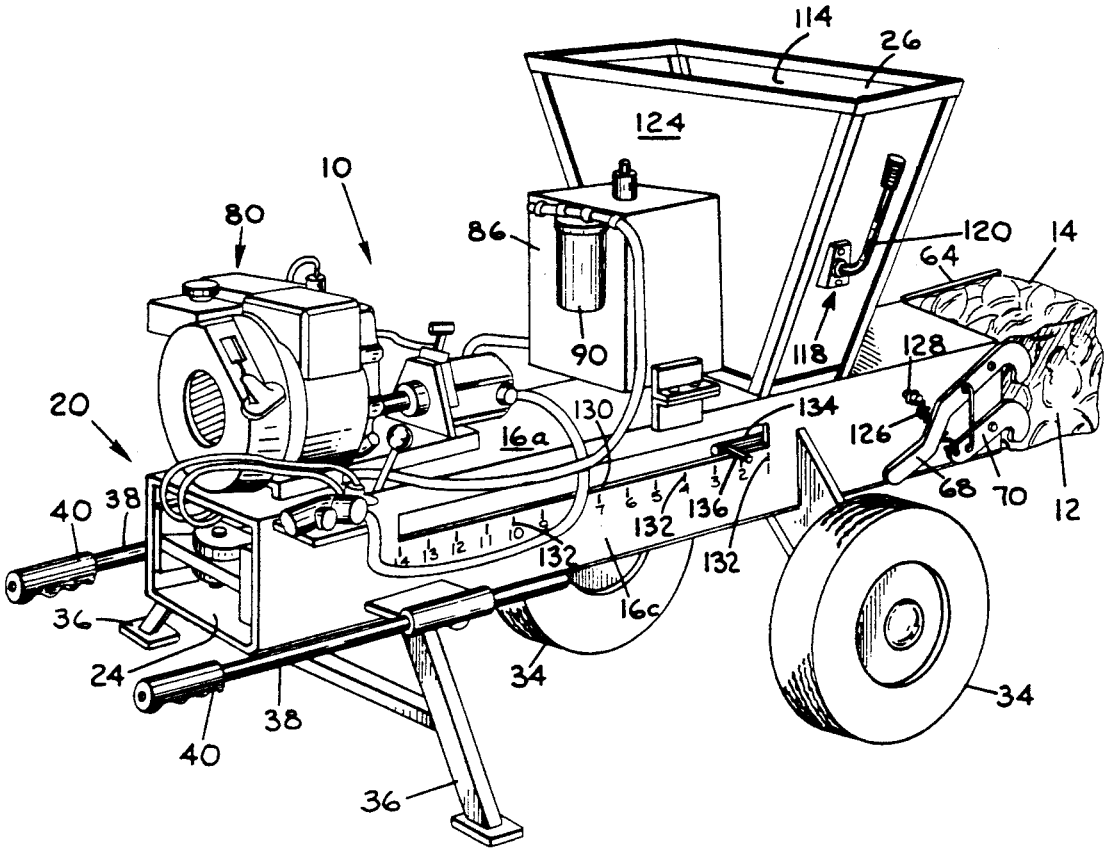
FIG. 12 is a perspective view of the alternate preferred embodiment of the device first shown in FIG. 9.

Referring to FIGS. 9, 11, and 12, there is shown an agitator bar 118 mounted to the hopper 26 and having a substantial portion extending through the interior of the hopper 26. The agitator bar 118 is essentially a long cylindrical piece of reinforcing bar bent at an angle so that one portion of the bar may function as a handle 120. Centrally mounted to that portion of the bar 118 which extends through the width of the hopper 26 is an agitator plate 122. The agitator plate 122 is a flat piece of steel which in its operative state moves back and forth within the hopper 26, and which is welded to the bar 118. Often times material 12 is deposited into the hopper 26 which hangs up, due to its unwieldy bulk and size, and does not fall through the aperture 22 and into the chamber 24. This is especially true of paint cans and coffee cans. Rapidly moving the handle 120 back and forth causes the agitator plate 122 to strike the paint cans and coffee cans, knocking them through the aperture 22 and into the chamber 24. As shown in FIG. 9, the agitator bar 118 is slightly offset so the majority of material 12 can fall cleanly through the hopper 26 for deposition into the chamber 24. When the device 10 is not in use, the agitator plate 122 can be tilted to the left-hand side, with reference to FIG. 9, so that the uppermost portion of the agitator plate 122 abuts the inside surface of a rear upright vertical wall 124 of the hopper 26.

Referring to FIG. 12 there is shown an elongated spring 126 which is attached to the end of the lower and smaller latch 70. The other end of the spring 126 is mounted or secured to a pin or rod 128 which projects from the sidewall **16*c* and is mounted to the housing 16. Because the upper latch 68 is larger than the lower latch 70, there is a tendency for the back of the upper and heavier latch 68 to drop down when there is no material 12 within the chamber 24. When the chamber door 64 is closed and the latches 68 and 70 are pivoted downward for engagement upon each respective latch bar 66, the spring 126 keeps the latches 68 and 70 in their engaged position with respect to the latch bars 66**.

Referring to FIGS. 9–12, there is shown a means for measuring the amount of material 12 baled during a baling operation. The means may be referred to as a bale measuring means and it includes several unique structural features. Cut into one sidewall **16*c* is an elongated slot 130 which extends approximately from where the hopper 26 is mounted to where the motor 80 is mounted. Beneath the slot 130 are numbered indicia 132 which mark off one-inch increments and extend from one inch to fourteen inches in the embodiment illustrated in FIG. 12. Mounted to the plate 60 adjacent that sidewall 16*c* is an elongated bar 134 which extends rearwardly from that reinforcing plate 60 and is parallel to the linear travel of the plunger 50 during extension and retraction within the chamber 24. When the plunger 50 is fully extended, the bar 134 extends approximately one foot beyond the plate 62. The bar 134 is mounted to the reinforcing plate 60 so that the bar 134 is adjacent to the slot 130 and moves concomitant with the linear extension and retraction of the plunger 50. At the distal end of the bar 134 is a threaded or tapped hole (not shown) for receiving an indicating dowel rod or pin 136. The pin 136 is threadably fastened into the tapped hole at the distal end of the bar 134 and projects perpendicular therefrom and out of the slot 130. The bar 134 is securely welded to the plate 60 and maintains its parallel position relative to the slot 130 during operation of the device 10**.

During a baling operation the plunger 50 is extended so the plunger face 52 and face protrusions 76 forcibly contact and engage material 12 deposited within the chamber 24 for compacting and deforming the material 12 against the chamber door 64 and the door protrusions 78. It usually takes several cycles of extension and retraction of the plunger 50 to compact and deform the material 12. When the last cycle has been completed, the user can determine how much material 12 has been baled by noting the numerical increment above which the pin 136 has stopped. This feature allows the user to translate an unknown volumetric quantity of material 12 into a linear measure so that, after the material 12 has been ejected from the chamber 24, the volume of the material 12 can be determined.

While there has been described and illustrated a preferred embodiment and several alternate embodiments of the present invention, it is apparent that numerous alterations, omissions, and additions may be made without departing from the spirit thereof.

I claim:

1. A compacting device disposed on a level surface for crushing material and compacting material into bales, comprising:

an elongated, square-shaped housing defined by a flat top member, an opposed floor, and a pair of vertically-depending sidewalls for enclosing a chamber which extends therethrough and into which material is deposited, the housing and the chamber extending generally horizontal to the level surface;

a reciprocable plunger for selective linear extension and retraction within the chamber, the extension and retraction occurring in a generally horizontal direction with respect to the level surface;

a plunger face mounted to the plunger for crushing and deforming material deposited within the chamber;

an exit chamber door attached to the housing for selectively closing the chamber and engaging material as a result of plunger extension forcing material against the door;

a wear plate mounted to the bottom of the plunger face and which rides upon the floor of the housing during plunger extension and retraction;

a pair of elongated, oppositely-disposed wear bars mounted to the floor and adjacent each respective sidewall of the housing and upon which the wear plate rides during retraction and extension of the plunger;

the housing having an elongated slot formed on one vertically-depending sidewall thereof adjacent the linear path of the plunger;

a plurality of measuring indicia arranged in a row and affixed to one of the vertically-depending sidewalls below the slot for indicating the amount of material baled during a baling operation; and indicator means aligned with and projecting through the slot above the indicia and moving concomitant with the retraction and extension of the plunger for indicating the amount of material baled during a baling operation.

2. The compacting device of claim 1 wherein the plunger face includes a plurality of equidistantly spaced-apart rectilinear plunger face protrusions mounted to the plunger face parallel to each other and projecting from the plunger face for forcibly contacting the material when the plunger is extended in the chamber.

3. The compacting device of claim 2 wherein the exit chamber door includes a plurality of equidistantly spaced-apart rectilinear chamber door protrusions mounted to the chamber door parallel to each other and projecting from the chamber door for contacting the material as a result of the material being driven thereagainst by plunger extension.

4. The compacting device of claim 3 wherein the plunger face protrusions move in non-intersecting parallel planes with respect to the parallel planes defined by the chamber door protrusions and form an interleaved arrangement with the chamber door protrusions whereby the plunger face and the plunger face protrusions forcibly contact and press the material against the chamber door and the chamber door protrusions for crushing and deforming the material into stable, compressed bales.

5. The compacting device of claim 1 wherein the indicator means includes an elongated rod secured to the plunger and extending rearwardly therefrom parallel to plunger travel and adjacent the slot.

6. The compacting device of claim 5 wherein the elongated rod includes an indicating pin removably secured to the distal end of the elongated rod and extending through the slot perpendicular to the elongated rod and above the indicia, the pin moving concomitant with the rod to indicate the amount of material baled in one baling operation.

7. A compacting device disposed on a level surface for crushing material and compacting material into bales, comprising:

an elongated, square-shaped housing defined by a flat top member, an opposed floor, and a pair of vertically-depending sidewalls for enclosing a chamber which extends therethrough and into which material is deposited, the housing and the chamber extending generally horizontal to the level surface;

a reciprocable plunger for selective linear extension and retraction within the chamber, the extension and retraction occurring in a generally horizontal direction with respect to the level surface;

a plunger face mounted to the plunger for crushing and deforming material deposited therein;

a plurality of equidistantly spaced-apart rectilinear plunger face protrusions mounted to the plunger face parallel to each other and projecting from the plunger face for forcibly contacting the material when the plunger is extended in the chamber;

an exit chamber door attached to the housing and adapted for selectively closing the chamber;

a plurality of equidistantly spaced-apart rectilinear chamber door protrusions mounted to the chamber door parallel to each other and projecting from the chamber door for contacting the material as a result of the material being driven against the chamber door and the chamber door protrusions by plunger extension;

the plunger face protrusions moving in non-intersecting parallel planes with respect to the parallel planes of the chamber door protrusions thus forming an interleaved arrangement with the chamber door protrusions whereby the plunger face and the plunger face protrusions forcibly contact and press the material against the chamber door and the chamber door protrusions for crushing and deforming the material into stable, compressed bales;

a hopper mounted to the flat top member of the housing adjacent the chamber door for receiving material to be compacted and which registers with the chamber for directing material into the chamber; and a shear bar mounted to the inside of the hopper adjacent and above the chamber for cutting material which extends from the hopper into the chamber by the plunger face extending beneath and past the shear bar, thus forcing the material against the shear bar and cutting the material.

8. The compacting device of claim 7 further comprising a wear plate mounted to the bottom of the plunger face which extends across the plunger face and rides upon the floor of the housing during plunger extension and retraction.

9. The compacting device of claim 8 further comprising a pair of elongated, spaced-apart wear bars disposed within the chamber and mounted to the floor of the housing adjacent each respective side wall and upon which the wear plate further rides during plunger extension and retraction.

10. A compacting device disposed on a level surface for crushing material and compacting material into bales, comprising:

an elongated, square-shaped housing defined by a flat top member, an opposed floor, and a pair of vertically-depending sidewalls for enclosing a chamber which extends therethrough and into which material is deposited;

a reciprocable plunger disposed within the housing for selective linear extension and retraction within the chamber, the extension and retraction occurring in a generally horizontal direction with respect to the level surface;

a plunger face mounted to the plunger for crushing and deforming material deposited within the chamber;

an exit chamber door attached to the housing for selectively closing the chamber and engaging the material as a result of plunger extension forcing material against the chamber door;

the housing having an elongated slot formed on one vertically-depending sidewall thereof adjacent the linear path of the plunger;

a plurality of measuring indicia arranged in a row and affixed to one of the vertically-depending sidewalls below the slot for indicating the amount of material baled during a baling operation; and indicator means projecting through the slot above the indicia and moving concomitant with the retraction and extension of the plunger for indicating the amount of material baled during a baling operation.

11. The compacting device of claim 10 wherein the plunger face includes a plurality of equidistantly spaced-apart rectilinear protrusions mounted parallel to each other and projecting from the plunger face for forcibly contacting the material when the plunger is extended in the chamber.

12. The compacting device of claim 11 wherein the exit chamber door includes a plurality of equidistantly spaced-apart rectilinear chamber door protrusions mounted to the chamber door parallel to each other and projecting from the chamber door for contacting the material as a result of the material being driven thereagainst by plunger extension.

13. The compacting device of claim 12 wherein the plunger face protrusions move in non-intersecting parallel planes with respect to the parallel planes defined by the chamber door protrusions and form an interleaved arrangement with the chamber door protrusions whereby the plunger face and the plunger face protrusions forcibly contact and press the material against the chamber door and the chamber door protrusions for crushing and deforming the material into stable, compressed bales.

14. A compacting device for conforming refuse material into a generally rectilinear bale, comprising:

an elongated housing having an open front end, an oppositely-disposed rear end, a material receiving aperture adjacent the front end, and a chamber extending from the front end to the rear end wherein the material is deposited;

an exit chamber door attached to the housing adjacent the front end and adapted for selective closure of the chamber to effect material compaction against the inner face of the door and the door adapted for opening thereof to permit ejection of the compacted material;

a reciprocable plunger adapted for selective linear extension and retraction within the chamber for compacting material;

the plunger having a flat plunger face disposed parallel to the exit chamber door and adapted to forcibly contact and compress material against the closed exit chamber door;

the plunger face having a plurality of equidistantly spaced-apart rectilinear plunger face protrusions parallel to one another and extending forwardly from the plunger face and toward the exit chamber door for forcibly contacting and compressing the material against the exit chamber door in order to compact the material;

the exit chamber door having a plurality of equidistantly spaced-apart rectilinear chamber door protrusions projecting from the inner face of the door and parallel to one another for projecting into the material as the material is being compacted to facilitate deformation of the material into a bale; and the plunger face protrusions being positioned on the plunger face to move in respective parallel planes that coincide with the spaces between the chamber door protrusions.

* * * * *